US006640351B1

(12) United States Patent
Diaz-Perez

(10) Patent No.: US 6,640,351 B1
(45) Date of Patent: Nov. 4, 2003

(54) TOILET FLUSHING APPARATUS

(76) Inventor: Clorindo Diaz-Perez, 1 Dickenson House, Dickenson Road, London N8 9ES (GB)

( * ) Notice: Subject to any disclaimer, the term of this patent is extended or adjusted under 35 U.S.C. 154(b) by 0 days.

(21) Appl. No.: 10/110,037

(22) PCT Filed: Oct. 5, 2000

(86) PCT No.: PCT/GB00/03822

§ 371 (c)(1),
(2), (4) Date: Aug. 27, 2002

(87) PCT Pub. No.: WO01/25552

PCT Pub. Date: Apr. 12, 2001

(30) Foreign Application Priority Data

Oct. 6, 1999 (GB) ..... 9923642

(51) Int. Cl.[7] ..... E03D 1/14; E03D 3/12

(52) U.S. Cl. ..... 4/325; 4/324; 4/381; 4/391; 4/410

(58) Field of Search ..... 4/324, 325, 378, 4/381, 384, 391, 394–401, 410, 411, 415

(56) References Cited

U.S. PATENT DOCUMENTS 4,486,906 A * 12/1984 Meier ..... 4/391
5,265,282 A * 11/1993 Schmucki ..... 4/325
5,669,082 A 9/1997 Sun ..... 4/325

FOREIGN PATENT DOCUMENTS

FR 2 740 795 A 5/1997
WO WO 97/17503 A1 * 5/1997 ..... 4/325

* cited by examiner

*Primary Examiner*—Tuan N. Nguyen
(74) *Attorney, Agent, or Firm*—Lahive & Cockfield, LLP

(57) ABSTRACT

In combination, a cistern and flushing apparatus, the cistern having an outlet (7), and the apparatus comprising a valve (3, 5) for closing the outlet, the valve having a seat (5) and a sealing member (3) movable onto and off the seat, an actuating float (1) constrained to move substantially vertically in the cistern and connected with the sealing member so that the buoyancy of the float acts to press the sealing member onto the seat, means (10) for holding the float against its buoyancy and an actuation mechanism (18, 18, 11) for releasing the float thereby to open the valve.

16 Claims, 6 Drawing Sheets

TOILET FLUSHING APPARATUS

This invention relates to a toilet flushing apparatus and is particularly concerned with such apparatus in combination with a cistern and having a dual flush capability.

It is an object of the present invention to provide a toilet flushing apparatus which is economical in its water usage and which may selectively provide either a short flush or a long flush.

It is a further object of the present invention to provide a toilet that can be activated with minimal effort and when the cistern is not yet full.

The present invention is, in combination, a cistern and flushing apparatus, the cistern having an outlet, and the apparatus comprising a valve for closing the outlet, the valve having a seat and a sealing member movable onto and off the seat, an actuating float constrained to move substantially vertically in the cistern and connected with the sealing member so that the buoyancy of the float acts to press the sealing member onto the seat, means for holding the float against its buoyancy and an actuation mechanism for releasing the float thereby to open the valve.

The apparatus may also include a pre-overflowing warning device which indicates to a user if the cistern over-fills even though no overflowing occurs.

Embodiments of the apparatus may provide a system which, when activated even though the cistern is empty, will automatically discharge when the cistern fills to a preset level thus avoiding small quantities of water being discharged when repeated attempts are made to actuate the mechanism before the cistern is fully filled.

The present invention is also flushing apparatus which when fitted to a cistern provides the combination defined in any of the last three preceding paragraphs.

Embodiments of the present invention will now be described with reference to the accompanying drawings in which.

Figure 1:
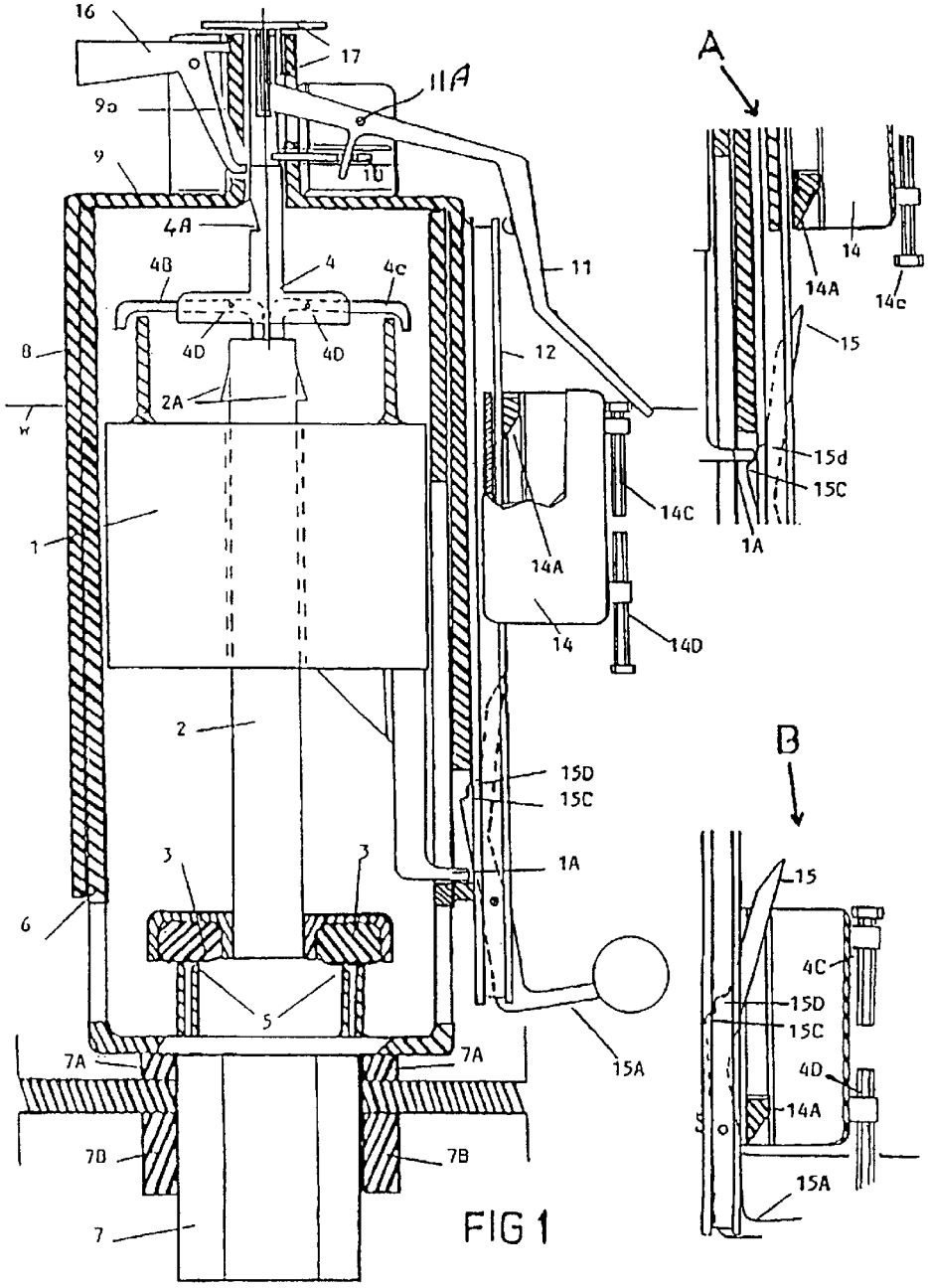
FIG. 1 is a cross-sectional view through toilet flushing apparatus according to the present invention in a cistern.
Figure 2:
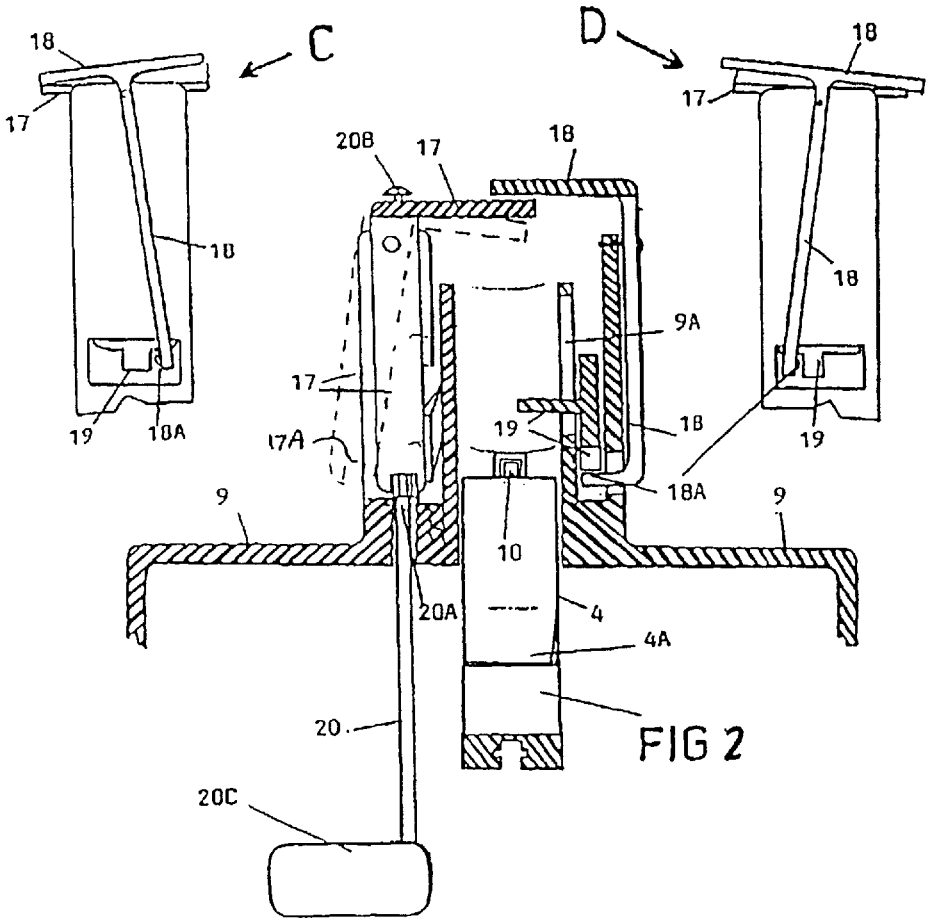
FIG. 2 is a cross section to an enlarged scale of the flushing control mechanism and pre-overflowing warning device of FIG. 1.

Referring to FIGS. 1 and 2 of the drawings, flushing apparatus according to the present invention is shown mounted in a cistern, and the force to lift open an outlet valve 3, 5 is provided by the buoyancy of an actuating float 1 having a lateral projection 1A, the float 1 being located around and freely movable vertically on a telescopically adjustable overflow and valve actuating rod or tube 2. The tube 2 carries at its lower end a valve sealing ring 3 in an annular holder, and a valve seat 5 is located around the cistern's outlet pipe 7.

When the cistern is filled to a preset level W, the actuating float 1 is prevented from rising by a linkage coupled with a control mechanism. The linkage has a body 4 with a detent 4A and lateral lever arms 4B and 4C which are pivoted at respective pivots 4D. These arms convert the upward buoyancy force of the float to a downward force on the tube 2 pressing the lower end thereof and the sealing ring 3 onto the seat 5 of the valve, the seat 5 having multiple walls or grooves and being located on the upper end of the outlet pipe 7.

The sealing ring 3 is, in this embodiment, of a chunky form and made of a soft jelly rubber of high flexibility and elasticity, but could be formed as a cushion filled with a fluid or a gel so that the down force of the actuating float on the seal forces the seal to deform to fit the shape of the multiple walled or grooved seat 5 to provide an enhanced seal even though there may be grit on the seat 5, or the seat may have worn with the passage of time. The characteristics of the seal ensure that it regains its original form every time it is off the seat 5.

The float I is constrained to move substantially vertically in the cistern by being housed in a cylindrical body 6 which is mounted on the top of the outlet pipe 7 and is sealed at 7A with a clamp gland nut 7B. The body 6 is telescopically embraced by a jacket 8 to enable the flushing mechanism to be fitted to different configurations of cistern. The top of the jacket 8 has a tube extension 9A open at both ends and in which the linkage body 4 is slidingly located. A trigger mechanism comprises a pin 10 coupled with a lever arm 11 and movable latterly out of the tube 9A when the lever arm 11 is rotated anticlockwise about its pivot 11 A thus releasing the body 4 to initiate the flush by lifting the tube 2 and hence the sealing ring 3.

This operation, in more detail, is as follows: lateral withdrawal of the pin 10 allows the float 1 to raise the body 4 in the tube 9A. The float 1 catches on detents 2A at the upper end of the tube 2 and this lifts the tube 2 moving the valve sealing ring 3 from the seat 5 to open the valve and permit flushing action. The arm 1A on the float 1 then moves and catches detent 15C or 15D of a lever 15 and the arm 1A is retained in the upper position. The lever 15 is biased anticlockwise by a buoyant float end 15A and this thus holds the arm 1A engaged whilst the water level in the cistern falls. When the water level in the cistern drops below the float arm end 15A, the end 15A falls and releases the float 1 which drops with the tube 2 and allows the sealing ring 3 to close the outlet 7. At that moment the body 4 falls and allows the pin 10 to move and reset. As the cistern refills, the float 1 rises to apply pressure to the arms 4D and 4C to force the tube 2 and seal 3 downward to sit tight on the outlet seat 5 in readiness for the next operation. The jacket 8 has a vertical side rail 12 along which slides a second float 14 which has a projection 14A and screws 14C and 14D, the projection and screws being vertically adjustable thus to preset the apparatus to discharge specific volumes of water. The float 14 rises and falls with the water level in the cistern.

The lever arm 15 is pivoted within the rail 12 and has the two stepped detents 15C and 15D. The detent 15C forms the short flush latch and the detent 15D forms the long flush latch. When on the detent 15C the upper tip of the lever arm 15 projects out of the rail 12 as shown at A in FIG. 1. Arm 1A is released by the float 14 falling when the tip of lever arm 15 is contacted by the projection 14A which moves the tip of the lever arm 15 against the buoyancy of the float end 15A thus allowing the float 1 and the tube 2 with the sealing ring 3 to drop and close the outlet 7. When on the detent 15D the tip of the lever arm 15 is fully within the rail 12 and is not contacted by the falling float 14 and thus the cistern discharges until the weight of the float 14 is applied on the an end 15A as at B in FIG. 1. Arm, 15 when released from projection 1A, slides through the duct 14B within the float 14.

It will be appreciated that the buoyancy of the arm end 15A is sufficient to hold the projection 1A but insufficient to prevent release through contact with the falling float 14.

Actuation of the flush is effected by the tipping of a lever 18 as can be best seen at C and D in FIG. 2. The lever 18 when tipped contacts and forces a lever 17 also to tip and disengage from the lever 11 as seen in broken lines. For the short flush, the lever 18 is tipped clockwise and the lower end of a lever 16 is biased inwardly to engage the detent 4A in body 4 thus restricting the rise of the body 4 and the float 1 such that the projection 1A on the float engages only the detent 15C in the arm 15. For the long flush, the body 4 is allowed to rise fully as the lever 18 is tipped anticlockwise to contact 16A forcing the lever 16 to rotate clockwise so that it cannot engage the detent 4A thus allowing the projection 1A of the float 1 to rise further to engage the detent catch 15D of arm 15 whereby the tip of arm 15 will not be contacted by the falling float 14 thus enabling a long flush discharging the cistern to a preset level. The actuating mechanism is biased to reset to pre-actuation position once the flush action permits.

In normal operation and after flush action lever 11 biases the pin 10 to reengage when body 4 falls with float 1 and tube 2. This is by virtue of the float 14 falling, this falling action being assured by reservoirs incorporated in the floats and 14. If the flush lever 18 is actuated before the cistern has refilled then the arm 11 is not locked and will be activated by the rising float 14 thus withdrawing the pin 10 to flush the cistern again when the water level has risen sufficiently. This is effected by a toggle action whereby a flush cannot be initiated until the float 1 has been reset and the cistern refilled. If the flush lever 18 is actuated before filling, then flushing is automatically initiated on the lifting of the lever 11 by the float 14, otherwise the lever 11 is held in the position shown. This is achieved by a latch system 19 engaging a foot 18A of lever 18 when tipped, as best shown at C and D in FIG. 2. The latch system allows the lever 11 to lift thus withdrawing the pin 10 when the float rises to a specific level providing a flush. This latch action occurs until the body 4 enters the tube 9 on initiation of the flush in order to reset the arrangement. If lever 18 has not previously been activated then lever 11 is held and no action occurs on the float 14 rising.

If the cistern overfills to a level above the preset one, the actuating control is rendered inoperative by an end 20A on lever 20 locking into a groove 17A of the lever 17 as a result of the float 20C rising above the desired water level W. This inability to flush in the normal way indicates to a user that there is an inlet valve malfunction requiring attention. In these circumstances, to initiate a flush a user will have to depress button 20B and thus lever 20 and float 20C as well as tipping the lever 18. The inconvenience of having to activate an additional mechanism may prompt a user to take action and reset the inlet valve, therefore saving valuable water.

Figure 3:
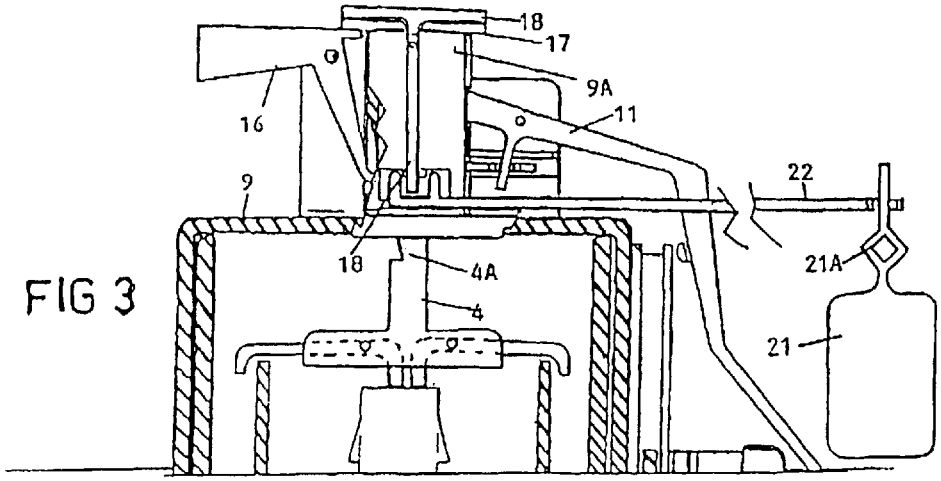
FIG. 3 is a cross-sectional view of part of a modified flushing control mechanism showing how the controls can also be accessed through the cistern wall instead of through the cistern cover.

Referring now to FIG. 3 there is shown a flushing apparatus similar to that of FIGS. 1 and 2 but modified to be activated by a rotatable shaft mounted through the cistern wall. Provided is a shaft (not shown) which couples to a weight 21 at 21 A. The weight is such that it biases the shaft to a neutral position as shown and is linked to one end of a lever 22 of which the other end is connected to the lower end of the lever 18. Rotation of the shaft will move lever 22 laterally to the right or the left thus activating lever 18 to initiate the flush, clockwise rotation giving the short flush and anticlockwise rotation giving the long flush. The weight 21 biases the lever 22 to its pre-actuation position once flushing action permits.

Figure 4:
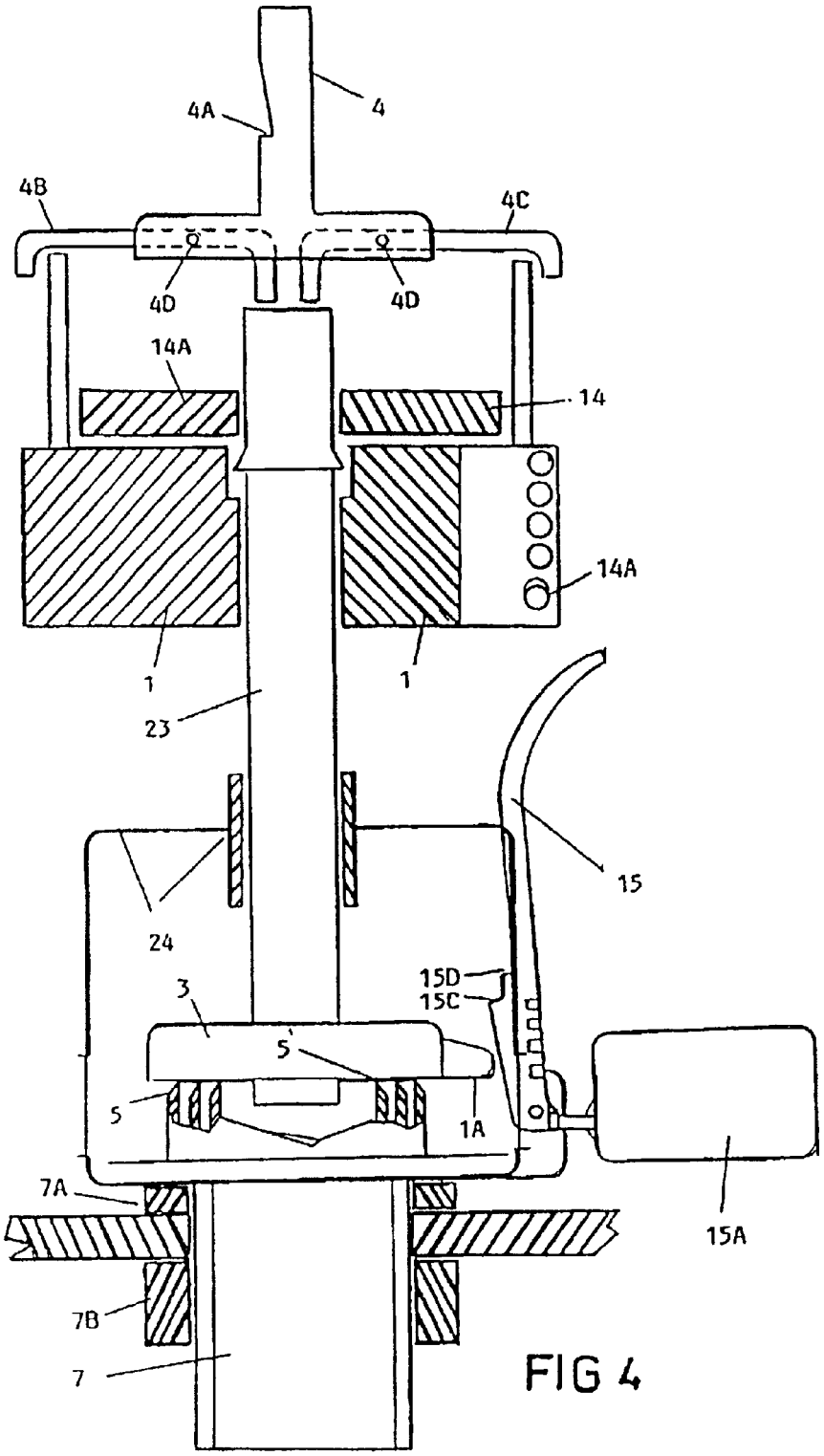
FIG. 4 shows a modified arrangement of the actuating floats and dual flush mechanisms.

Referring now to FIG. 4 there is shown a modified arrangement of the actuating floats and dual flush mechanism in which the float 14 is located around and is freely movable vertically on the overflow and valve actuating tube 23 which is movable as in FIG. 1 and is supported by a low frame 24 mounted on the outlet pipe 7. In the embodiment of FIG. 4, the actuating mechanism (not shown) can be mounted to depend from the cistern cover instead of being fixed on the jacket 8 and can be one of or similar to those shown in FIGS. 1, 2 and 3.

Also in FIG. 4 embodiment, the projection 1A projects from the holder of the seal 3 so that the float 1 is free to drop with the water level and the short flush ends when the tip of a lever 15 is contacted by the knob 14A which is fitted to any one of a plurality of holes located on float 1 rather than on float 14. For the long flush the tip of the lever 15 is not contacted by knob 14A and the flush action ends when the water level falls below buoyant end 15A which is larger and provided with reservoirs to ensure that is heavy and falls to disengage detent 15D from projection 1A thus the actuating tube 2 and sealing ring 3 drop to seal the outlet 7.

Figure 5:
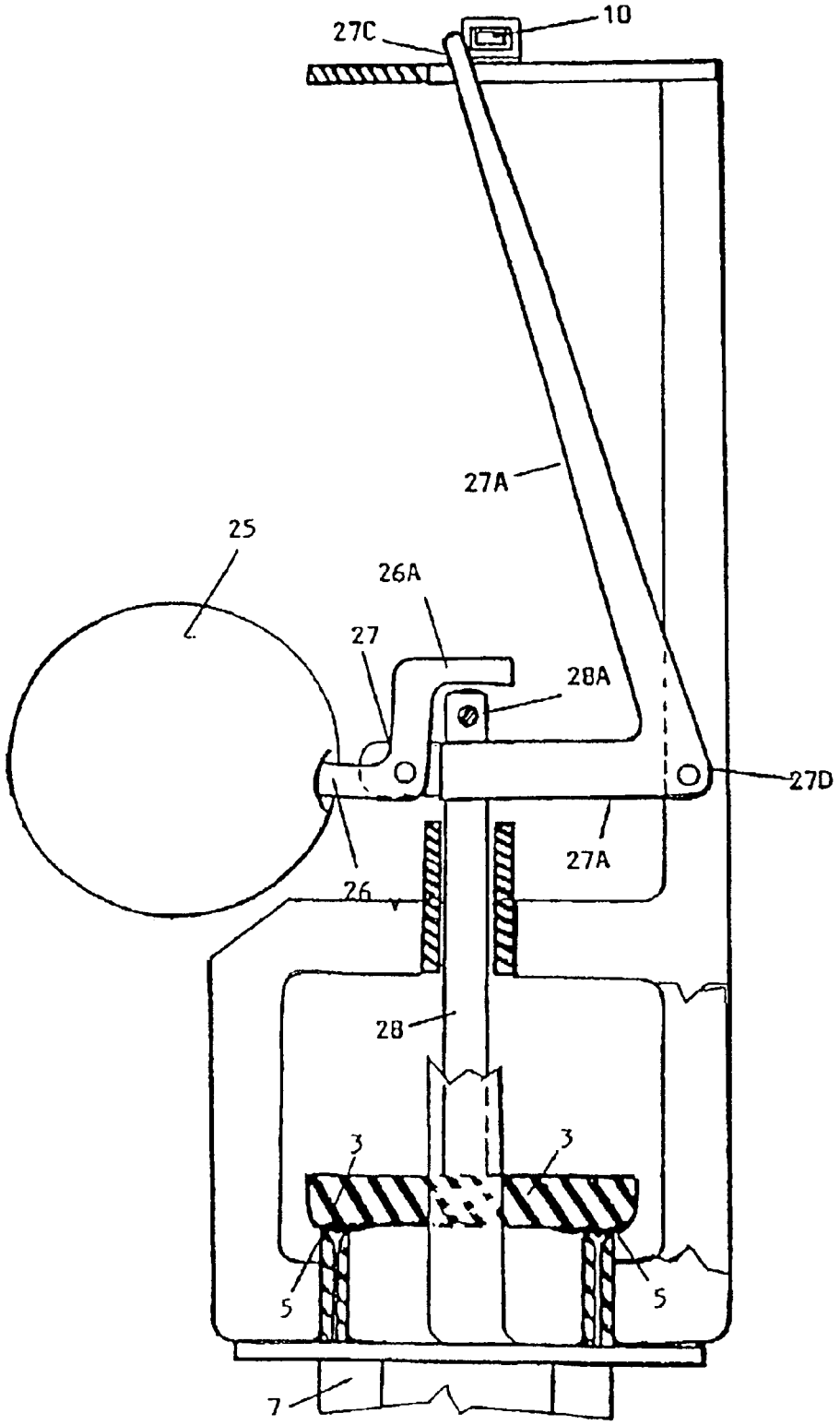
FIG. 5 shows a second modified arrangement of the valve actuating float.

FIG. 5 shows in detail a second modified arrangement of the valve actuating float which differs from those shown in FIGS. 1, 3 and 4 in that the actuating float 25 fits to one end 26 of the crank arm 26A which is mounted on a locking pivot to one end 27 of secondary arm 27A pivot at 27D and held at 27C by trigger pin 10.

The operation of the FIG. 5 embodiment is as follows: clockwise and upward force of the actuating float 25 is transferred downward by arm end 26A onto the actuating tube 28 and thereon the seal 3 and seat 5, and on actuation of the controls the trigger pin 10 disengages from arm tip 27C and at that moment the float 25 and arm 27A are free to continue clockwise and upward rotation engaging detent 28A therefore lifting the valve open.

Figure 6:
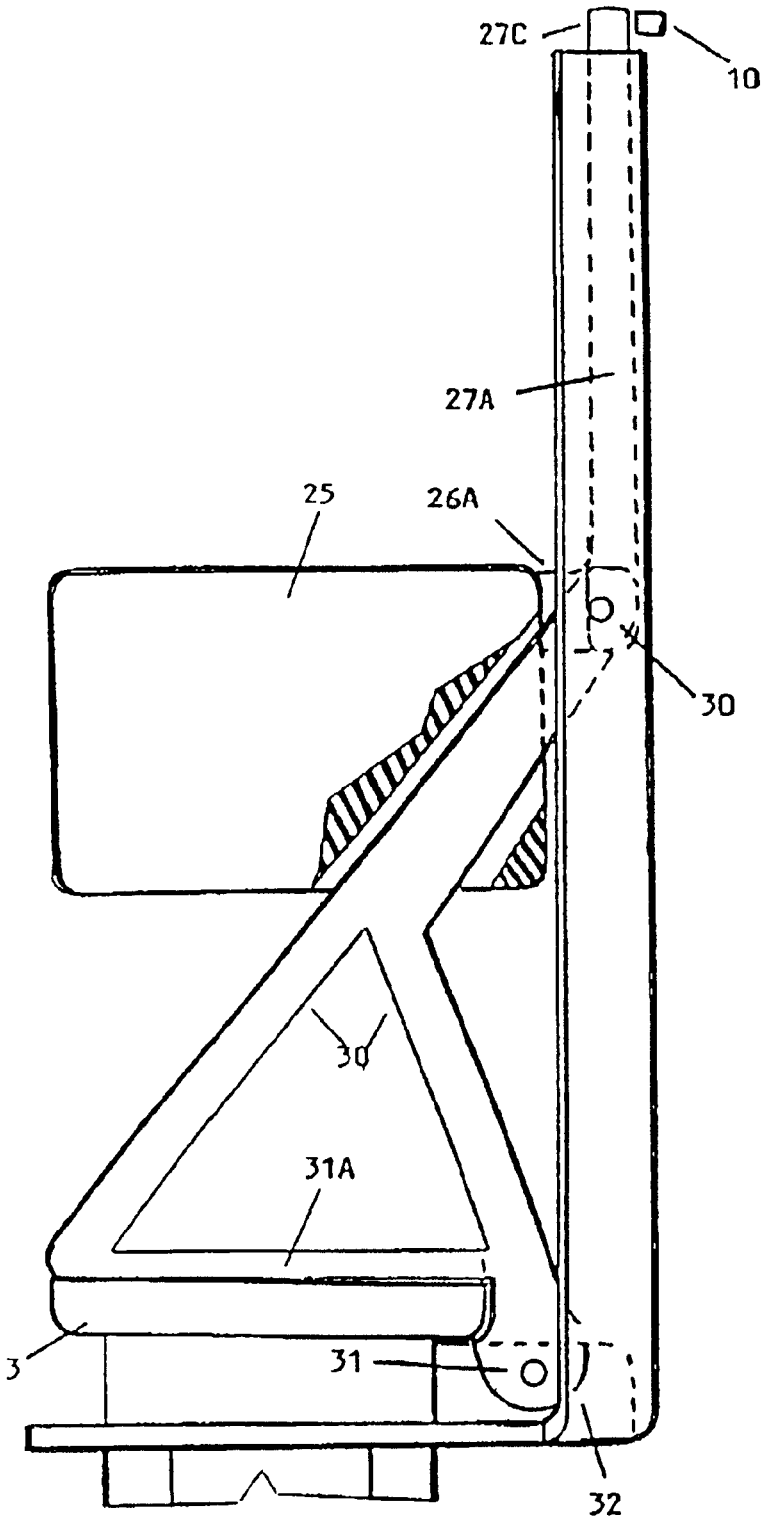
FIG. 6 shows a third modified arrangement of the valve actuating float.

FIG. 6 shows a third modification of the actuating float mounted on pivoted arms as in FIG. 5, and differs in that the float 25 arms 26A, 27A pivot on a frame 30 which in turn is pivoted at 31 on a lug 32 and provides support to the seal 3 at 31*a*. Thus the pivoting frame 32 opens the valve.

Figure 7:
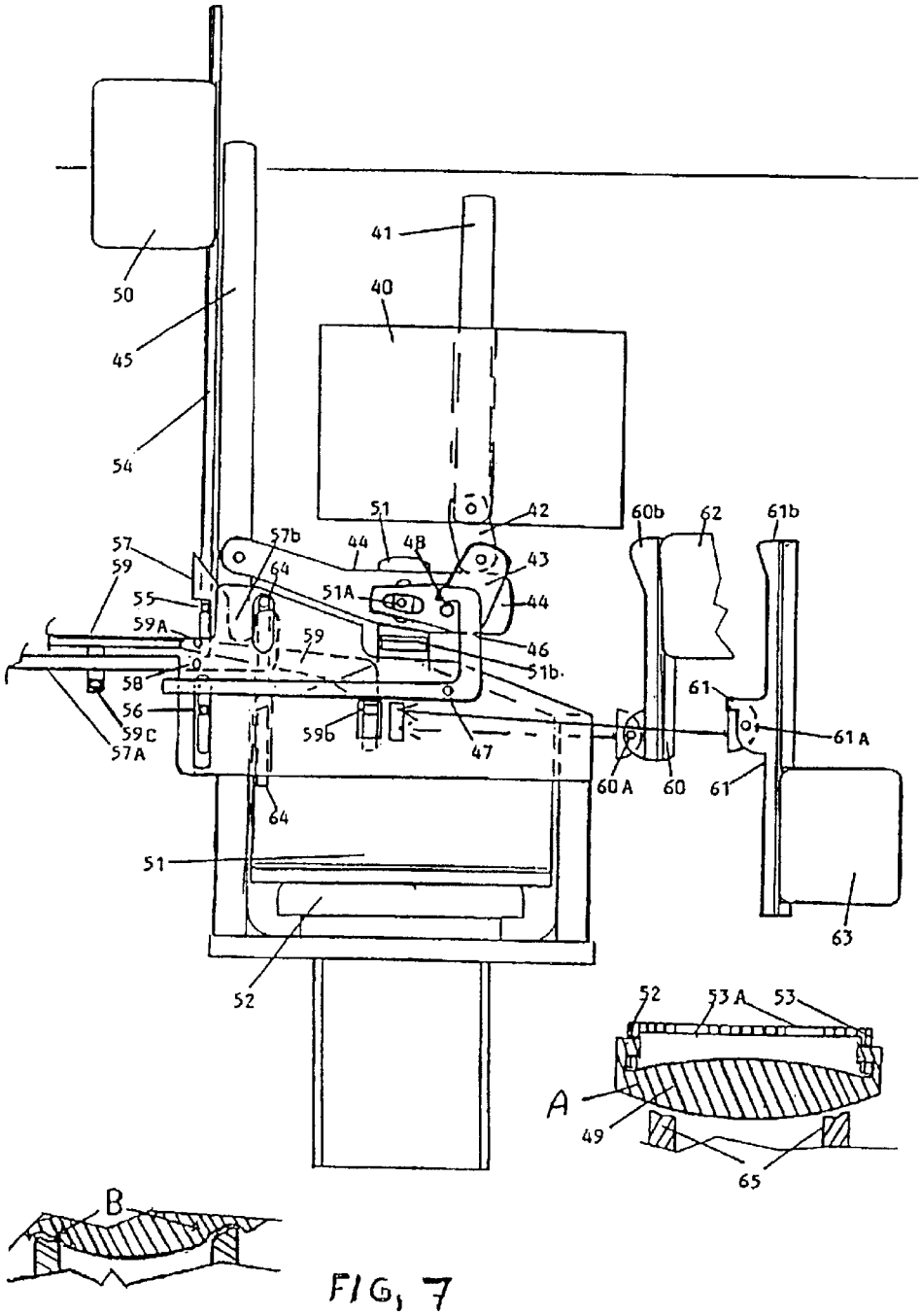
FIG. 7 shows a further embodiment of a flushing mechanism according to the present invention.

In the embodiment of FIG. 7 all moving parts are submerged thus minimising the possibility of malfunctions brought about by the build up of minerals which normally occurs around or above the waterline W.

The actuating float 40 is fitted to a lever 41 which pivots on one end of a three part linkage comprising arms 42, 43 and 44, the other end of the linkage being pivotally mounted on the valve supporting frame 45. Trigger 46 pivots at 47 and catches on one of the arm pivot pins 48, so that the lifting force of the float 40 is transferred downward and onto the seal 49, such a force is transferred downward by the knob 51A on wall 51 which embodies a projection at 51B and at the blind side 51C (not shown) and is vertically movable and supports the seal holder 52. The initiating float 50 is fined to a lever 54 which is vertically movable and adjustable having a detent at 55 and at 56. Flush latch 57 pivots at 58 and catches at detent 55 inhibiting the float 50 from lifting and when activated by lifting at 57A it will determine the short flush. A secondary flush latch 59 is provided, this determine the long flush and is pivoted at 59A and has a projection at 59B and 59C and when activated projection 59C will interact with and activate flush latch 57. The valve is maintained at the open position for the duration of the flush by a pair of buoyant latches 60 and/or 61. Latch 60 supports a vertically adjustable float 62 and is pivoted at 60A and when active tip 60B will engage with projection 51 C. Latch 61 also supports an adjustable float 63 and is pivoted at 61A and tip 61B engages with projection 51B when active.

A vertically sliding catch 64 provides the opportunity to activate the flush when the cistern is still empty. When latch 57 is activated catch 64 falls into a groove 57B detaining 57 in the activated position until the cistern fills and the flush is initiated by the rising of float 50, catch 64 will also when activated detained latch 59 in the activated position until the flush is initiated as above.

In this embodiment the seal 49 shown at A, FIG. 7, has the characteristics as explained with reference to FIGS. 1 and 2, but differs in that it is a disc rather than a ring and is supported by a ring 52. The ring 52 has a cover 53 with openings 53A which ensure that the water pressure forces it to deform from within as shown at B in FIG. 7, thus providing further protection against leakage.

The operation is as follows. Actuation of the flush latch 57 and/or 59 will set the arm free so that the float regains the upper lifting force and opens the valve. The valve is opened due to the activation of the flush latch 57 and once the valve is open float 62 forces tip 60B to engage with projections 51C therefore the short flush is discharged. Actuation of the flush latch 59 will allow tip 61B to engage projection 51B which otherwise remains inoperative interacted by projection 59B and will remain engaged until the water drops below the float 63, therefore the long flush is discharged.

What is claimed is:

1. In combination, a cistern and flushing apparatus, the cistern having an outlet, and the apparatus comprising a valve for closing the outlet, the valve having a seat and a sealing member movable onto and off the seat, an actuation float constrained to move substantially vertically in the cistern and connected with the sealing member so that the bouyancy of the float acts to press the sealing member onto the seat, means for holding the float against its buoyancy and an actuation mechanism for releasing the float thereby to open the valve.

2. The combination as claimed in clam 1, in which the float is connected with the sealing member through arms pivotally mounted on a body connected with the sealing member.

3. The combination as claimed in claim 2, in which the body is located above the float and the sealing member is located beneath the float.

4. The combination as claimed in claim 3. in which the body is connected to the sealing member by a rod passing through the float, the rod having at an upper end detents engageable with the float.

5. The combination as claimed in claim 2, in which said means for holding the float against its buoyancy comprising a member limiting the vertical movement of said body.

6. The combination as claimed in claim 5, in which the member is movable transversely into and out of the path of movement of the body.

7. The combination as claimed in claim 6, including an actuating mechanism for moving the member, actuating mechcanism including a pivoted lever in engagement with said member and a second float engageable with an end of said lever to rotate the lever about its pivot and move the member out of the path of the body.

8. The combination as claimed in claim 7, including a trigger mechanism for releasing the lever for rotation.

9. The combination as claimed in claim 8, in which the trigger mechanism includes a rotatable shaft having a central rotational position to which it is biased, rotation of the shaft in one direction from the central position causing a long flush, and rotation of the shaft in the other direction causing a short flush.

10. The combination as claimed in claim 8, in which the body is connected to the sealing member by a rod passing through the float, the rod having at an upper end detents engageable with the float, and in which the trigger mechanism limits the movement of the rod to a selected one of a plurality of positions which determine the length of the flush.

11. The combination as claimed in claim 10, including a buoyant lever arm engageable with the actuating float to hold the float and the rod in the selected position, and engageable with the second float to release the actuating float and terminate the flush.

12. The combination as claimed in claim 10, including a third float having a member therein which interferes with the operation of the trigger mechanism when the water level in the cistern is too high.

13. The combination as claimed in claim 1, in which the valve seat has multiple grooves or walls.

14. The combination as claimed in claim 1, in which the sealing member is made of a soft rubber of high flexibility and elasticity.

15. The combination as claimed in claim 1, in which the sealing member is a cushion filled wit a fluid or gel.

16. The combination as claimed in claim 1, in which the sealing member is a disc with one face which engages the seat, the other ace being open to the pressure of water in the cistern.

* * * * *